US009633605B2

(12) United States Patent
Ishii et al.

(10) Patent No.: US 9,633,605 B2
(45) Date of Patent: Apr. 25, 2017

(54) PIXEL CIRCUIT HAVING DRIVING METHOD FOR THRESHOLD COMPENSATION AND DISPLAY APPARATUS HAVING THE SAME

(71) Applicant: SAMSUNG DISPLAY CO., LTD., Yongin, Gyeonggi-Do (KR)

(72) Inventors: Ryo Ishii, Yokohama (JP); Daisuke Kawae, Yokohama (JP); Masayuki Kumeta, Yokohama (JP); Eiji Kanda, Yokohama (JP); Takeshi Okuno, Yokohama (JP)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 4 days.

(21) Appl. No.: 14/319,052

(22) Filed: Jun. 30, 2014

(65) Prior Publication Data

US 2015/0002557 A1 Jan. 1, 2015

(30) Foreign Application Priority Data

Jul. 1, 2013 (JP) ..... 2013-138029

(51) Int. Cl.
*G09G 3/32* (2016.01)
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0861* (2013.01); *G09G 2310/0262* (2013.01); *G09G 2320/045* (2013.01)

(58) Field of Classification Search
CPC ..... G09G 3/3208; G09G 3/3233
USPC ..... 345/78, 82
See application file for complete search history.

(56) References Cited

U.S. PATENT DOCUMENTS

2011/0025671 A1* 2/2011 Lee ..... G09G 3/003 345/211
2011/0109531 A1* 5/2011 Choi ..... G09G 3/3233 345/76
2012/0001893 A1* 1/2012 Jeong ..... G09G 3/3233 345/213
2012/0019499 A1* 1/2012 Hwang ..... G09G 3/325 345/211
2013/0257698 A1* 10/2013 Toya ..... H01L 27/124 345/77

(Continued)

FOREIGN PATENT DOCUMENTS

JP 2006-301159 A 11/2006
JP 2009-216782 A 9/2009

(Continued)

*Primary Examiner* — Long D Pham
(74) *Attorney, Agent, or Firm* — Lee & Morse P.C.

(57) ABSTRACT

A pixel circuit includes a first path coupled to a gate of a driving transistor and a second path passing through a source and drain of the driving transistor. An initialization voltage of the driving transistor is set based on a gray scale data voltage carried along the first path. A voltage is stored in a capacitor coupled to the gate of the driving transistor based on the gray scale data voltage carried along the second path. The voltage stored in the capacitor is based on the gray scale data voltage, and may be compensated for variation in a threshold voltage of the driving transistor.

5 Claims, 10 Drawing Sheets

100

(56) References Cited

U.S. PATENT DOCUMENTS

| | | | | |
|---|---|---|---|---|
| 2014/0049531 | A1* | 2/2014 | Kwak | G09G 1/005 345/211 |
| 2014/0340377 | A1* | 11/2014 | Kishi | G09G 3/3225 345/211 |

FOREIGN PATENT DOCUMENTS

| | | | |
|---|---|---|---|
| JP | 2009-258227 | A | 11/2009 |
| JP | 2009-294635 | A | 12/2009 |
| WO | WO 2012/065594 | * | 5/2013 |

* cited by examiner

SCANa=L
$V_{CST}=V_{BAS}\rightarrow V_{SET}$
SCANb=H
EM=H
$V_G=V_{DATA}$

SCANa=H
$V_{CST}=V_{SET}\rightarrow V_{BAS}$
SCANb=H
EM=H
$V_G=V_{DATA}-(V_{BAS}-V_{SET})$ SCANa=H
$V_{CST}=V_{BAS}$
SCANb=L
EM=H
$V_G=V_{DATA}-|V_{th}|$ SCANa=H
$V_{CST}=V_{BAS}$
SCANb=H
EM=L
$V_G=V_{DATA}-V_{th}$

PIXEL CIRCUIT HAVING DRIVING METHOD FOR THRESHOLD COMPENSATION AND DISPLAY APPARATUS HAVING THE SAME

CROSS-REFERENCE TO RELATED APPLICATION

Japanese Patent Application No. 2013-138029, filed on Jul. 1, 2013, in the Japanese Intellectual Property Office, and entitled, "Pixel Circuit, Driving Method, And Display Apparatus Having The Same," is incorporated by reference herein in its entirety.

BACKGROUND

1. Field

One or more embodiments described herein relate to a display device.

2. Description of the Related Art

In recent years, a display device has been developed which uses emission (e.g., organic electroluminescence) elements to emit light based on an amount of supplied current. The pixels of this device use driving transistors to control the emission elements. When the characteristics of the driving transistors vary (e.g., as a result of deterioration or other effects), the quality of the display device is adversely affected.

SUMMARY

In accordance with one embodiment, a pixel circuit includes an emission element; a driving transistor configured to provide the emission element with current corresponding to a gray scale data voltage supplied from a gray scale data signal line; a first switch electrically connected to the gray scale data signal line and a gate of the driving transistor, the first switch configured to be controlled by a first control signal; a capacitor having a first terminal electrically connected to the gate of the driving transistor and a second terminal receiving a second control signal; and a second switch electrically connected to a drain and the gate of the driving transistor, the second switch controlled by a third control signal.

The pixel circuit may include a third switch electrically connected to the drain of the driving transistor and the emission element. The pixel circuit may include a fourth switch electrically connected to the gray scale data signal line and a source of the driving transistor; and a fifth switch electrically connected to a power line and the source of the driving transistor.

In accordance with another embodiment, a method for driving a pixel circuit includes writing a gray scale data voltage to a gate of a driving transistor; and shifting a level of the gray scale data voltage written at the gate of the driving transistor to set an initialization voltage of the driving transistor. Shifting the level of the gray scale data voltage may include writing the gray scale data voltage at the gate of the driving transistor through a first path that passes through the driving transistor; and writing the gray scale data voltage at the gate of the driving transistor through a second path different from the first path.

The method may include changing a voltage level of a second control signal coupled to a terminal of a capacitor electrically connected to a gate of the driving transistor, the voltage level of the second control signal changed between a first operation of writing the gray scale data voltage through the first path and a second operation of writing the gray scale data voltage through the second path; and providing an emission element with current from the driving transistor, the current provided based on the gray scale data voltage stored in the capacitor after the second operation.

The second operation may be performed by turning on a first switch and writing the gray scale data voltage at the gate of the driving transistor through the first switch, the first switch electrically connected to a gray scale data signal line providing the gray scale data voltage and the gate of the driving transistor, the first switch controlled by a first control signal. The first operation may be performed by turning on a second switch and writing the gray scale data voltage at the gate of the driving transistor through the second switch and the driving transistor, the second switch electrically connected to a terminal and the gate of the driving transistor, the second switch controlled by a third control signal.

In accordance with another embodiment, a display device includes a pixel circuit including an emission element; a driving transistor configured to provide the emission element with current corresponding to a gray scale data voltage from a gray scale data signal line; a first switch electrically connected to the gray scale data signal line and a gate of the driving transistor, the first switch configured to be controlled by a first control signal; a capacitor having a first terminal electrically connected to the gate of the driving transistor and a second terminal configured to receive a second control signal; and a second switch electrically connected to a drain and the gate of the driving transistor, the second switch configured to be controlled by a third control signal.

The display device may include a third switch electrically connected to a drain of the driving transistor and the emission element. The display device may include a fourth switch electrically connected to the gray scale data signal line and a source of the driving transistor; and a fifth switch electrically connected to a power line and the source of the driving transistor.

In accordance with another embodiment, a pixel circuit includes a driving transistor; a first path coupled to a gate of the driving transistor; and a second path passing through a source and a drain of the driving transistor, wherein an initialization voltage of the driving transistor is based on a gray scale data voltage carried along the first path and a voltage is stored in a capacitor coupled to the gate of the driving transistor based on the gray scale data voltage carried along the second path, and wherein the voltage stored in the capacitor is based on the gray scale data voltage.

The voltage stored in the capacitor may be compensated for variation in a threshold voltage of the driving transistor. The initialization voltage of the driving transistor may change from a first voltage to the gray scale data voltage when the gray scale data voltage is carried along the first path. The first voltage may be less than the gray scale data voltage.

The pixel circuit may include a first switch in the first path; and a second switch in the second path, wherein the first switch is controlled by a first signal and the second switch is controlled by a second signal. The first signal may have a first value when the second signal has a second value, and the second signal may have the first value when the first signal has the second value. The first and second signals may be scan signals.

The first and second paths may be coupled to a data line. At least one of the first path or the second path may receive a power voltage from the data line.

The pixel circuit may include a switch to direct the gray scale data voltage along the first path when the switch is in a first state, and to direct the gray scale data voltage along the second path when the switch is in a second state. The switch may be controlled by a scan signal.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
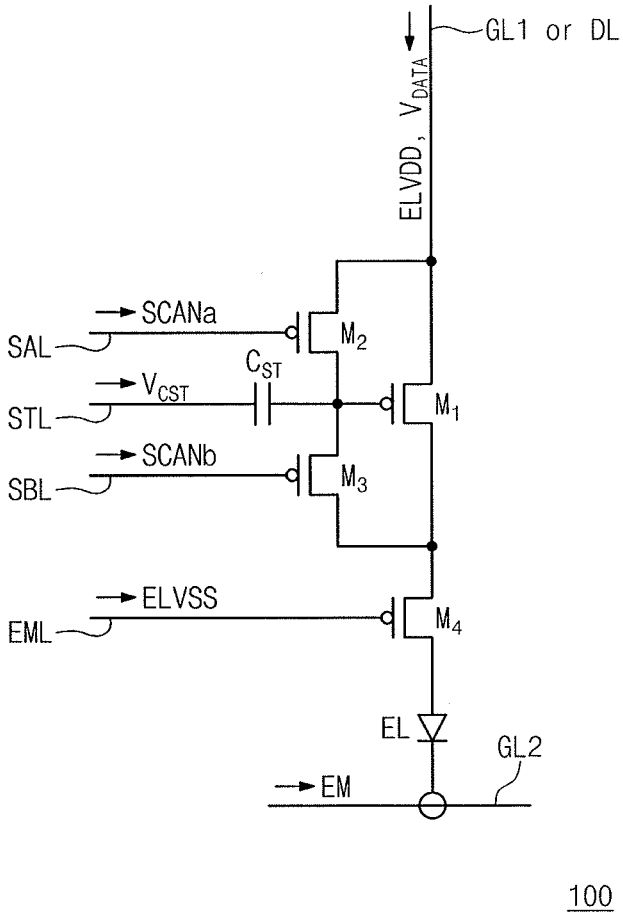
FIG. 1 illustrates an embodiment of a pixel circuit.
Figure 2A:
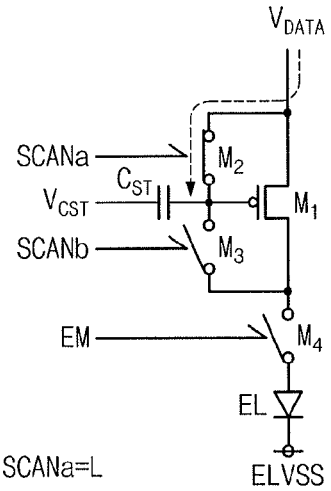
FIGS. 2A-2D illustrate an example of how the pixel circuit operates.
Figure 2B:
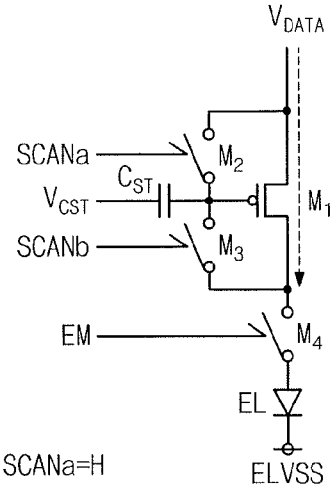
Figure 2C:
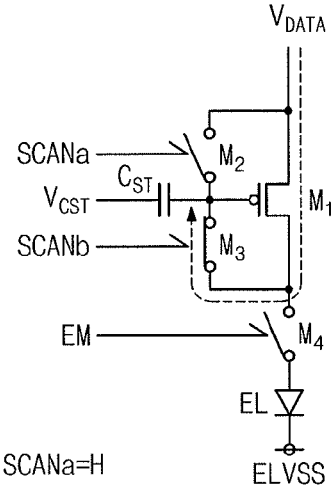
Figure 2D:
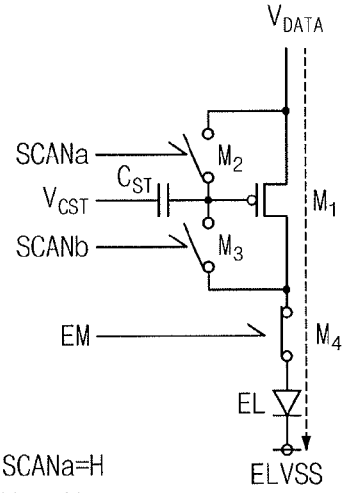

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

It will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present.

FIG. 1 illustrates a portion 100 of a pixel circuit according to one embodiment. In FIG. 1, the portion 100 includes transistors $M_1$, $M_2$, $M_3$, and $M_4$, a storage capacitor $C_{ST}$, and an emission element EL.

Transistor $M_1$ is a driving transistor that includes a drain electrically connected to a data signal line DL and a source electrically connected to a gate of driving transistor $M_1$ through transistor $M_3$. One terminal of the storage capacitor $C_{ST}$ is electrically connected to the gate of driving transistor $M_1$ and the other terminal of the storage capacitor $C_{ST}$ is electrically connected to receive an initialization setting signal line STL.

Transistor $M_2$ has a first terminal electrically connected to data signal line DL, a second terminal electrically connected to the gate of driving transistor $M_1$, and a gate coupled to receive a scan signal SCANa (first control signal).

As previously indicated, capacitor $C_{ST}$ has a first terminal electrically connected to the gate of driving transistor $M_1$ and a second terminal electrically connected to receive initialization setting signal line STL. The voltage to be stored in capacitor $C_{ST}$ is controlled by an initialization setting signal $V_{CST}$ (second control signal).

Transistor $M_3$ is connected electrically between the drain and gate of driving transistor $M_1$, and has a gate coupled to receive a scan signal SCANb (a third control signal).

Transistor $M_4$ is connected electrically between the drain of driving transistor $M_1$ and an anode of emission element EL, and has a gate coupled to receive an emission control signal EM.

Emission element EL may be, for example, an organic light emitting diode. In operation, driving transistor $M_1$ supplies current corresponding to gray scale data voltage $V_{DATA}$ to the emission element EL. The emission element emits light based on this current.

The gray scale data voltage $V_{DATA}$ is written in storage capacitor $C_{ST}$ when transistor $M_2$ turns on. When transistor $M_4$ turns on, a current is supplied to emission element EL based on gray scale data voltage $V_{DATA}$ stored in storage capacitor $C_{ST}$.

In portion 100 of the pixel circuit, an initialization voltage may be changed based on gray scale data voltage $V_{DATA}$ at every pixel, and a variation in the threshold voltage of driving transistor $M_1$ of each pixel may be accurately corrected. Transistors $M_1$, $M_2$, $M_3$, and $M_4$ in FIG. 1 are P-type transistors. In other embodiments, portion 100 may be implemented using N-type transistors or different types of switches may be used for transistors $M_1$, $M_2$, $M_3$, and $M_4$.

Figure 3:
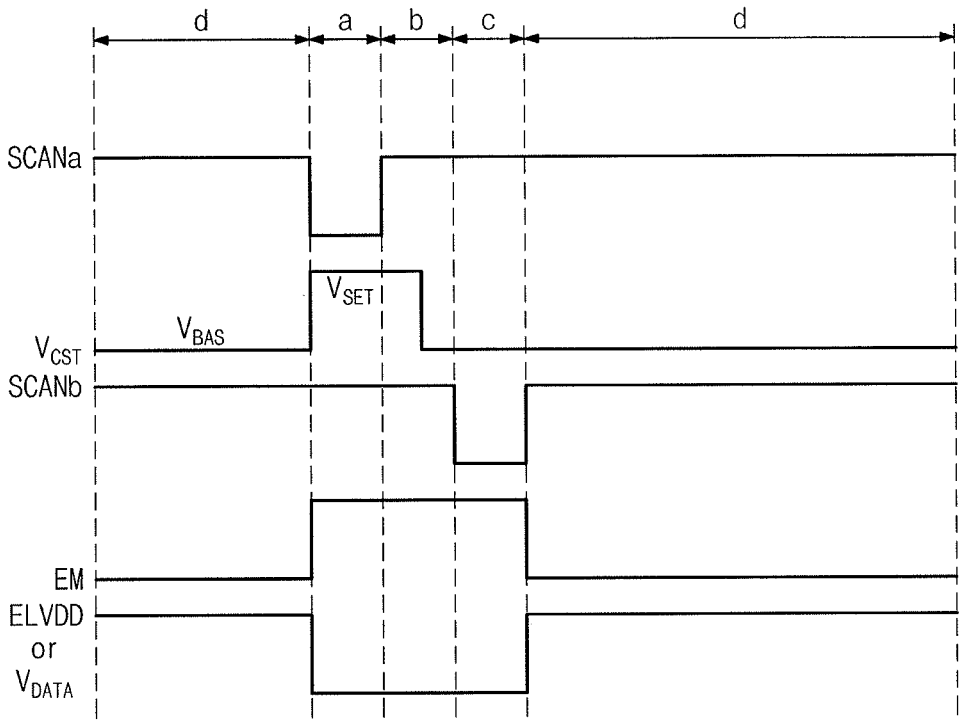
FIG. 3 illustrates an example of a timing diagram for the pixel circuit.

FIG. 2A to 2D illustrate how portion 100 of the pixel circuit operates according to one embodiment, and FIG. 3 is a timing diagram illustrating signals for controlling portion 100.

In period (a), transistor $M_2$ is turned on in response to a low level of scan signal SCANa and a gray scale data voltage $V_{DATA}$ is written in storage capacitor $C_{ST}$. At this time, transistor $M_3$ is turned-off. Also, a voltage of initialization setting signal $V_{CST}$ may change from $V_{BAS}$ to $V_{SET}$. The amplitude ($V_{BAS}-V_{SET}$) of initialization setting signal VCST may be determined, for example, based on a time of period (a), a characteristic of driving transistor $M_1$, and/or a capacitance value of storage capacitor $C_{ST}$.

In period (b), scan signal SCANa transitions to a high level and transistor $M_2$ is turned off. Also, the voltage of initialization setting signal $V_{CST}$ may change from $V_{SET}$ to $V_{BAS}$, and the gate voltage of driving transistor $M_1$ is set to ($V_{DATA}-(V_{SET}-V_{BAS})$).

In period (c), scan signal SCANb is set to a low level, transistor $M_3$ is turned on, and driving transistor $M_1$ is in a diode-connected state. At this time, gray scale data voltage $V_{DATA}$ is written in storage capacitor $C_{ST}$. The driving transistor M1 is turned off when its gate voltage is ($V_{DATA}-|Vth|$), and gray scale data voltage $V_{DATA}$ for compensation of the threshold voltage Vth of driving transistor $M_1$ is maintained in storage capacitor $C_{ST}$.

In period (d), transistor $M_3$ is turned off by setting scan signal SCANb to a high level. As transistor $M_4$ turns on in response to a high-to-low transition of emission control signal EM, current flows into emission element EL according to the gray scale data voltage VDATA in the storage capacitor $C_{ST}$. As a result, emission element EL emits light.

From FIGS. 2A to 2D, it is evident that, before the gray scale data voltage is carried on a path that passes through driving transistor $M_1$ in the diode-connected state, the gray scale data voltage is carried along a path that passes through transistor $M_2$. An initialization voltage of driving transistor $M_1$ is therefore set based on the gray scale data voltage that is written in the storage capacitor. Thus, in this embodiment, it is possible to change the initialization voltage based on gray scale data voltage $V_{DATA}$ provided to each pixel, and to accurately compensate for variation in the threshold voltage of the driving transistor $M_1$ of each pixel.

Figure 4:
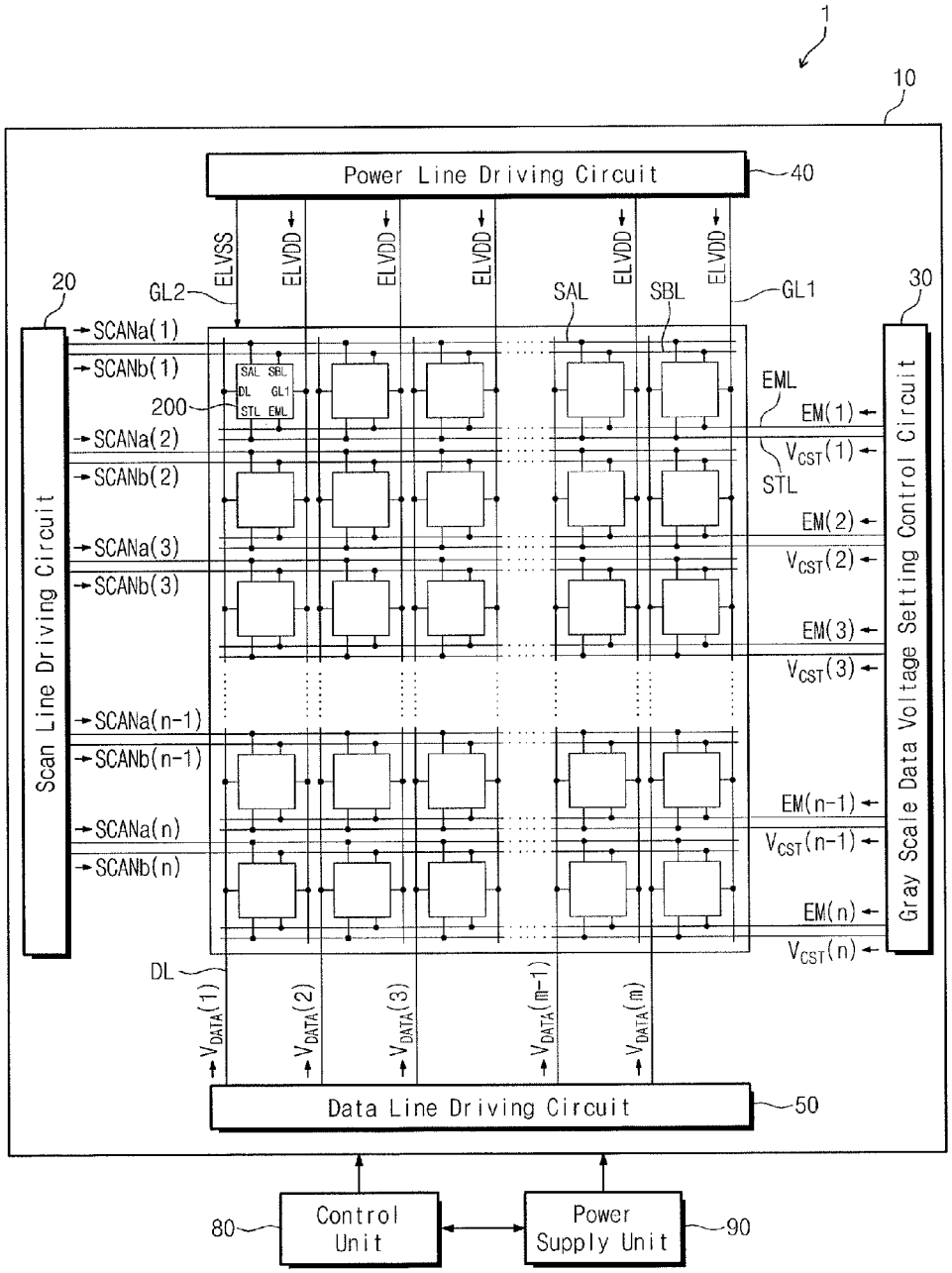
FIG. 4 illustrates an embodiment of an electronic device.

FIG. 4 illustrates an embodiment of an electronic device 1 which includes a display device 10, a control unit 80, and a power supply unit 90. The electronic device may be, for example, a smart phone, portable phone, personal computer, a television, or another device or system which includes a display.

The display device 10 has a plurality of pixel circuits 200 arranged in a matrix shape. Each pixel circuit 200 has an emission element EL (e.g., refer to FIG. 5). The display device 10 displays images based on emission of light from the emission elements. In one embodiment, emission element EL may be an emission element using organic EL. In another embodiment, the emission element may be another type of light emitter which generates light based on an applied current.

Also, while pixel circuits 200 are arranged in an n×m matrix shape in FIG. 4, in other embodiments pixel circuits 200 may be disposed to have another matrix shape. Also, the emission element EL may be arranged so that light of a different color is generated every column or according to another predetermined arrangement. For example, emission elements EL for generating red, green, and blue light may be sequentially and iteratively arranged, in order, from a first column.

The control unit 80 may include but is not limited to a processor (e.g, a central processing unit (CPU), controller, etc.) and a memory. The control unit 80 controls operation of display device 10. For example, control unit 80 controls a scan line driving circuit 20, a gray scale data voltage setting control circuit 30, a power line driving circuit 40, and a data line driving circuit 50. Also, control unit 80 determines a gray scale value to be expressed from each pixel circuit 20 based on image data to be displayed on a display unit of electronic device 1. Control unit 80 controls emission of light from the emission element EL of each pixel circuit 200 by allowing a data line driving circuit to supply a gray scale data voltage corresponding to the determined gray scale value to pixel circuit 200.

The power supply unit 90 supplies power to at least display device 10 and control unit 80, and optionally other components of electronic device 1. The emission element EL of each pixel circuit 20 is supplied with current through power lines GL1 and GL2 that are electrically connected to power supply unit 90.

The scan line driving circuit 20 provides scan signal SCANa and scan signal SCANb to respective first scan line SAL and second scan line SBL connected to the pixel circuits 200 in each row. Scan line driving circuit 20 selects a row of pixel circuits 200 in which a gray scale data voltage is to be written based on scan signals SCANa and SCANb. In one embodiment, first to nth rows may be sequentially selected in a predetermined order.

The gray scale data voltage setting control circuit 30 provides initialization setting signal $V_{CST}$ and emission control signal EM respectively to initialization setting signal line STL and an emission control signal line EML connected to pixel circuits 200 in each row. The gray scale data voltage setting control circuit 30 may set an initialization voltage of pixel circuit 200 by setting initialization setting signal $V_{CST}$ to a predetermined voltage level, and may control emission/non-emission of pixel circuit 200 based on emission control signal EM. The gray scale data voltage setting control circuit 30 may sequentially provide initialization setting signal $V_{CST}$ and emission control signal EM from the first row to the nth row of pixel circuits 200 in a predetermined order and in synchronization with scan signals SCANa and SCANb.

The data line driving circuit 50 supplies gray scale data voltages $V_{DATA}$ to respective data signal lines DL for each column of pixel circuits 200. The gray scale data voltage $V_{DATA}$ determines a gray scale level of an emission element EL of pixel circuit 200, and may be set to a voltage according to a gray scale level of a corresponding pixel circuit 200.

The power line driving circuit 40 supplies power supply voltages ELVDD and ELVSS to respective power lines GL1 and GL2. The power supply voltages ELVDD and ELVSS may be used to supply a current for causing the emission elements of pixel circuits 200 to emit light. Also, in FIG. 4, an example is illustrated in which power line GL2 is used as a common electrode for supplying power supply voltage ELVSS to the emission elements EL. However, like power line GL1 for light emitting, power line GL2 may be provided for light emitting correspond to each column of pixel circuits.

Figure 5:
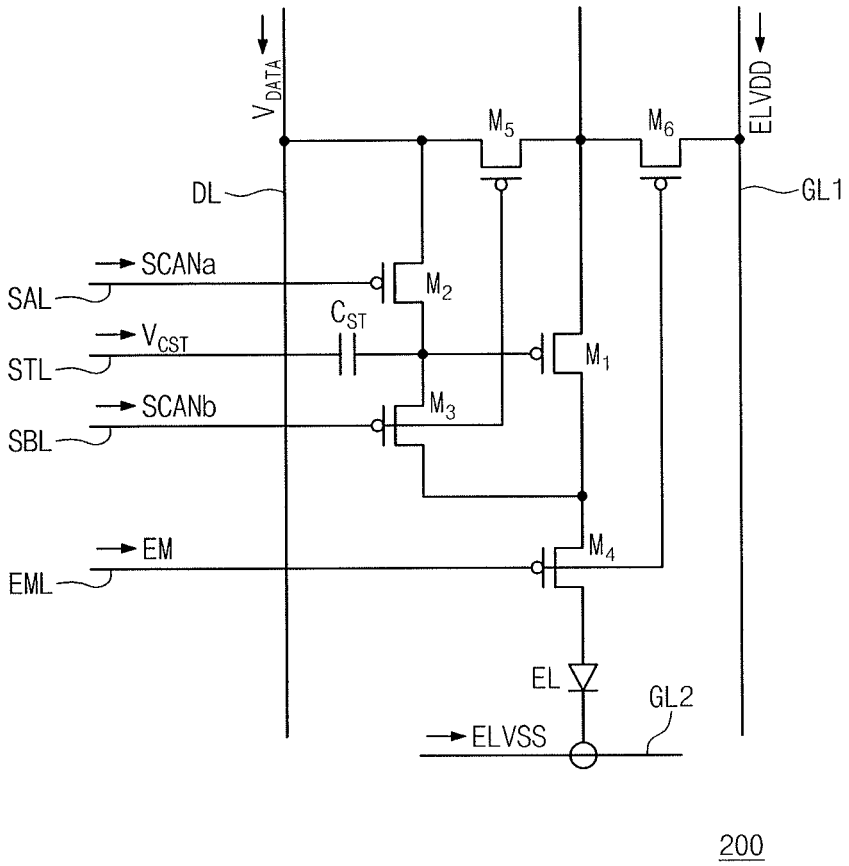
FIG. 5 illustrates another embodiment of a pixel circuit.

FIG. 5 illustrates another embodiment of a pixel circuit 200 which includes transistors $M_1$, $M_2$, $M_3$, $M_4$, $M_5$, and $M_6$, storage capacitor $C_{ST}$, and emission element EL. Transistor $M_1$ is a driving transistor which supplies current corresponding to a gray scale data voltage VDATA to emission element EL.

Transistor $M_2$ has a first terminal electrically connected to data signal line DL, a second terminal electrically connected to the gate of driving transistor $M_1$, and a gate coupled to receive scan signal SCANa.

The storage capacitor $C_{ST}$ has a first terminal electrically connected to the gate of driving transistor $M_1$, a second terminal electrically connected to initialization setting signal line STL, and a gate coupled to receive initialization setting signal $V_{CST}$.

Transistor $M_3$ is electrically connected between two terminals (e.g., a gate and drain) of the driving transistor $M_1$, and has a gate coupled to receive scan signal SCANb.

Transistor $M_4$ is connected electrically between one terminal (e.g, the drain) of driving transistor M1 and an anode of emission element EL.

Transistor M5 is disposed between data signal line DL and a node coupled to driving transistor M1, and has a gate coupled to receive scan signal SCANb.

Transistor switch M6 is between power line GL1 and the node coupled to driving transistor $M_1$, and has a gate coupled to receive emission control signal EM. The data signal line DL and power line GL1 are electrically connected to a terminal (e.g., the source of) driving transistor $M_1$ through transistors $M_5$ and $M_6$.

The pixel circuit 200 may be driven, for example, based on the timing diagram of FIG. 3. In period (a), transistor $M_2$ is turned on in response to a low level of scan signal SCANa and gray scale data voltage $V_{DATA}$ is written in storage capacitor $C_{ST}$. At this time, transistors $M_3$ and $M_5$ are turned-off. Also, a voltage of initialization setting signal $V_{CST}$ may change from $V_{BAS}$ to $V_{SET}$. At this time, the amplitude ($V_{BAS}-V_{SET}$) of the initialization setting signal $V_{CST}$ may be determined, for example, based on a time corresponding to period (a), a characteristic of driving transistor $M_1$, and capacitance value of capacitor $C_{ST}$.

In period (b), scan signal SCANa transitions to a high level and transistor $M_2$ is turned off. Also, a voltage of initialization setting signal $V_{CST}$ may change from $V_{SET}$ to $V_{BAS}$. In this case, the gate voltage of driving transistor $M_1$ is set to ($V_{DATA}-(V_{SET}-V_{BAS})$).

In period (c), scan signal SCANb is set to a low level, transistors $M_3$ and $M_5$ turn on and driving transistor $M_1$ is in a diode-connected state. At this time, gray scale data voltage $V_{DATA}$ is written in the storage capacitor $C_{ST}$. Driving transistor M1 is turned off when its gate voltage is ($V_{DATA}-|Vth|$), and gray scale data voltage $V_{DATA}$ for compensation of a threshold voltage Vth of the driving transistor $M_1$ is maintained in the storage capacitor $C_{ST}$.

In period (d), transistors $M_3$ and $M_5$ are turned off by setting scan signal SCANb to a high level. As transistors $M_4$ and $M_6$ turn on in response to a high-to-low transition of emission control signal EM, current flows into emission element EL based on the gray scale data voltage $V_{DATA}$ in storage capacitor $C_{ST}$. As a result, emission element EL emits light.

In pixel circuit 200, as described above, before the gray scale data voltage is carried on a path through driving transistor $M_1$ in a diode-connected state, the gray scale data voltage may be carried through a path through transistor $M_2$. An initialization voltage of driving transistor $M_1$ is set based on the gray scale data voltage. Thus, in this embodiment, the initialization voltage may be changed based on gray scale data voltage $V_{DATA}$ provided to each pixel, and variation in the threshold voltage of the driving transistor $M_1$ of each pixel may be accurately compensated.

Also, a pixel circuit may be configured to write gray scale data voltage $V_{DATA}$ in capacitor $C_{ST}$ through a path which does not include driving transistor $M_1$, and to electrically connect transistor $M_2$ to a source and a gate of driving transistor $M_1$.

Figure 6:
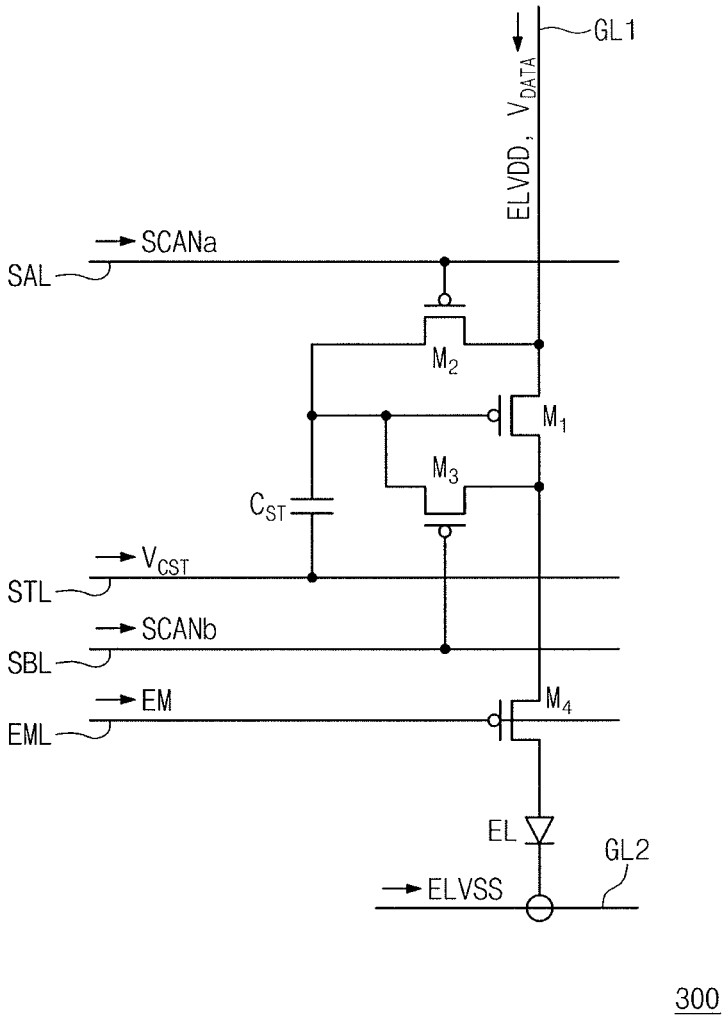
FIG. 6 illustrates another embodiment of a pixel circuit.

FIG. 6 illustrates another embodiment of a pixel circuit 300 which includes transistors $M_1$, $M_2$, $M_3$, and $M_4$, storage capacitor $C_{ST}$, and emission element EL. Transistor $M_1$ is a driving transistor which supplies current to emission element EL based on gray scale data voltage $V_{DATA}$.

Transistor $M_2$ is connected electrically to a source and a gate of driving transistor $M_1$ and has a gate coupled to receive scan signal SCANa. The storage capacitor $C_{ST}$ having a first terminal connected electrically to the gate of driving transistor $M_1$ and a second terminal connected electrically to initialization setting signal $V_{CST}$. Transistor $M_3$ is connected electrically to a drain and gate of driving transistor $M_1$ and has a gate coupled to receive scan signal SCANb. Transistor $M_4$ is electrically connected between the drain of driving transistor M1 and an anode of emission element EL and has a gate coupled to receive emission control signal EM.

Figure 7:
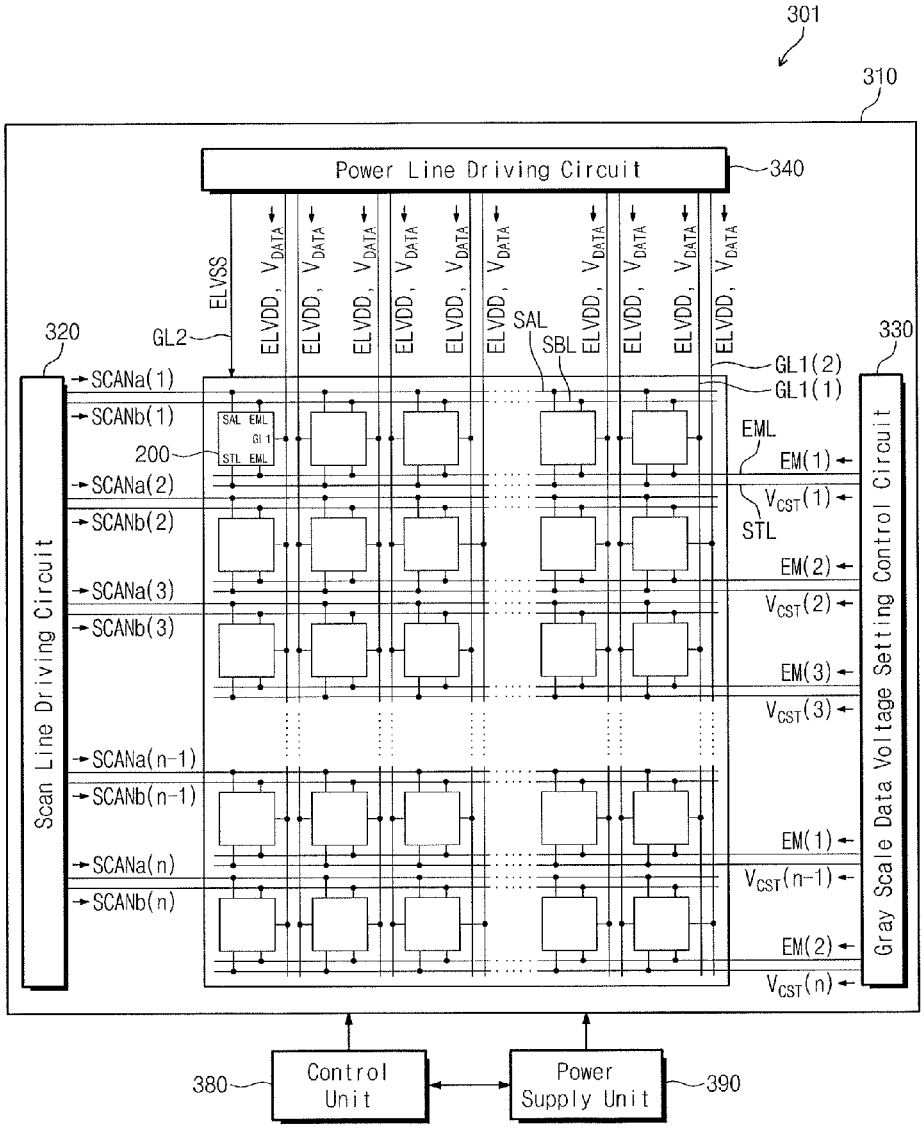
FIG. 7 illustrates another embodiment of an electronic device.

FIG. 7 illustrates another embodiment of an electronic device 301 which includes a display device 310, a scan line driving circuit 320, a gray scale data voltage setting control circuit 330, and a power line driving circuit 340.

The scan line driving circuit 320 provides scan signal (first control signal) SCANa and scan signal (third control signal) SCANb to a first scan line SAL and a second scan line SBL, respectively. The scan line driving circuit 20 selects a row of pixel circuits 300 in which a gray scale data voltage is to be written based on scan signals SCANa and SCANb. In one embodiment, scan line driving circuit 320 selects first to nth rows sequentially according to a predetermined order.

The gray scale data voltage setting control circuit 330 provides an initialization setting signal $V_{CST}$ to an initialization setting signal line STL of pixel circuits in each row. The gray scale data voltage setting control circuit 330 supplies an emission control signal EM1 to an emission control signal line EML connected to pixel circuits 300 of odd-numbered rows, and an emission control signal EM2 to an emission control signal line EML connected to pixel circuits 300 of even-numbered rows.

The gray scale data voltage setting control circuit 330 may set an initialization voltage of pixel circuit 300 by setting initialization setting signal $V_{CST}$ to a predetermined voltage level, and may control emission/non-emission of pixel circuit 300 using emission control signals EM1 and EM2. The gray scale data voltage setting control circuit 330 sequentially provides initialization setting signal $V_{CST}$ from the first row to the nth row of pixel circuits 300 in a predetermined order and in synchronization with scan signals SCANa and SCANb.

If an odd-numbered row of pixel circuits 300 is selected by scan signals SCANa and SCANb, emission control signal EM1 is set to a high level under control of the gray scale data voltage setting control circuit 330. If an even-numbered row of pixel circuits 300 is selected by scan signals SCANa and SCANb, emission control signal EM2 is set to a high level under a control of gray scale data voltage setting control circuit 330.

The power line driving circuit 340 supplies power supply voltage ELVDD or gray scale data voltage $V_{DATA}$ to power line GL1 for emission elements in each column of pixel circuits 300. The power supply voltages ELVDD and ELVSS may be used to supply current for causing the emission elements to emit light.

Also, in FIG. 7, an example is illustrated in which power lines GL1(1) and GL1(2) are disposed at each column of pixel circuits 300 and are connected to pixel circuits 300 in an odd-numbered and even-numbered columns, respectively.

Also, in FIG. 7, an example is illustrated in which power line GL2 is used as a common electrode to supply power supply voltage ELVSS to emission element ELs of pixel circuits 300. In one embodiment, power line GL2 may be disposed to correspond to each column of pixel circuits 300.

During a period where pixel circuits 300 in an odd-numbered row are selected, gray scale data voltage $V_{DATA}$ is supplied to power lines GL1(1) and GL1(2). The gray scale data voltage $V_{DATA}$ may indicate a gray scale level of the emission element EL of each pixel circuit 300, and may be set to a voltage corresponding to a gray scale level of each pixel circuit 300.

Figure 8:
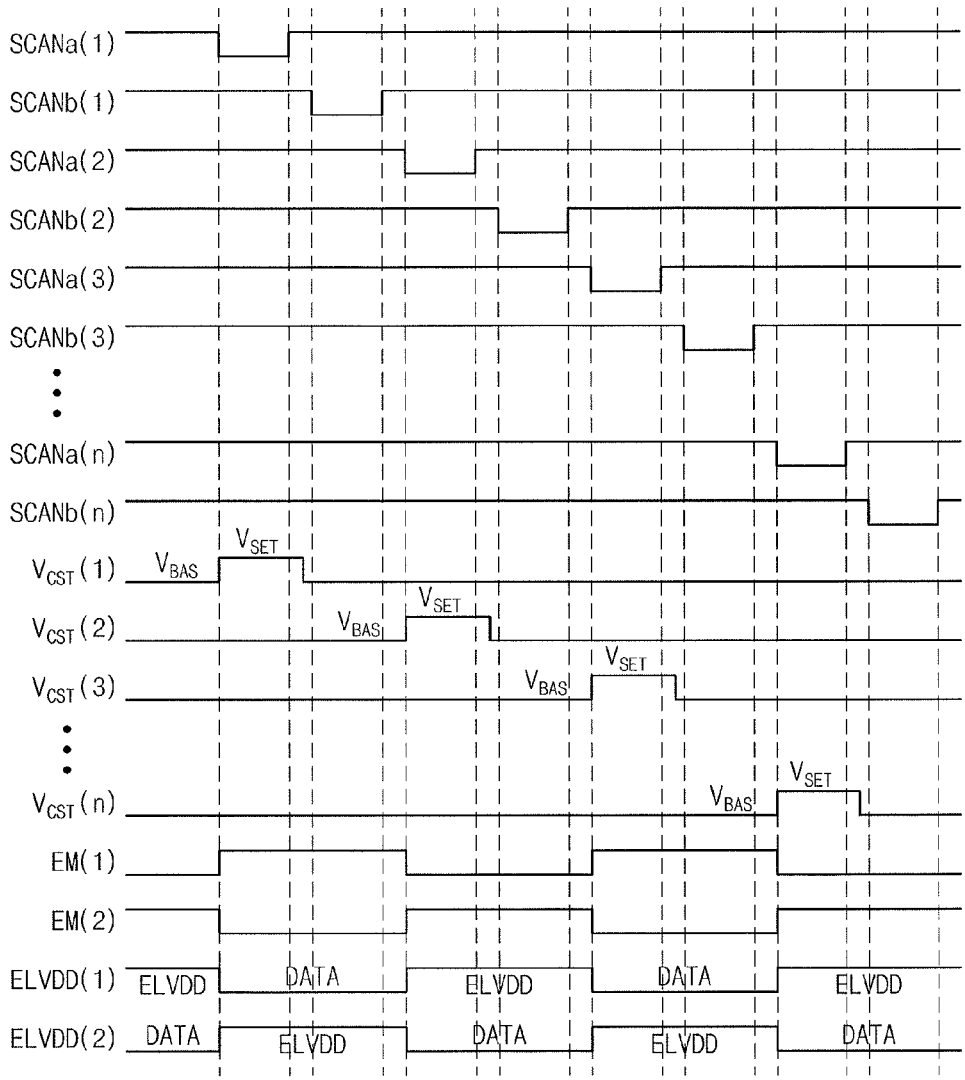
FIG. 8 illustrates an example of a timing diagram a display device.

FIG. 8 illustrates an example of a timing diagram for controlling a display device according to another embodiment. In FIG. 8, scan signal SCANa(n) is supplied to a first scan line SAL at the nth row. When transistor $M_2$ is turned on in response to a low level of scan signal SCANa(n), gray scale data voltage $V_{DATA}$ is written in storage capacitor $C_{ST}$. At this time, a third control signal SCANb(n) having a high level at the nth row is received from second scan line SBL, and transistor $M_3$ is turned off.

Next, a voltage of initialization setting signal $V_{CST}$(n) transitions from $V_{BAS}$ to $V_{SET}$. At this time, the amplitude ($V_{BAS}-V_{SET}$) of initialization setting signal $V_{CST}$(n) may be determined, for example, based on a characteristic of driving transistor $M_1$ and a capacitance value of storage capacitor $C_{ST}$.

Then, as scan signal SCANa(n) transitions to a high level, transistor $M_2$ is turned off, and a voltage of initialization setting signal $V_{CST}(n)$ may change from $V_{SET}$ to $V_{BAS}$. In this case, a gate voltage of driving transistor $M_1$ is set to $(V_{DATA}-(V_{SET}-V_{BAS}))$.

Afterwards, scan signal SCANb(n) is set to a low level, transistor $M_3$ turns on, and driving transistor $M_1$ is in a diode-connected state. At this time, gray scale data voltage $V_{DATA}$ is written in storage capacitor $C_{ST}$. Driving transistor $M_1$ is turned off when its gate voltage is $(V_{DATA}-|Vth|)$, and gray scale data voltage $V_{DATA}$ for compensation of the threshold voltage Vth of driving transistor $M_1$ is maintained in storage capacitor $C_{ST}$.

Then, transistor $M_3$ is turned off by setting scan signal SCANb(n) to a high level. A transistor $M_4$ is turned on in response to a high-to-low transition of emission control signal EM, current flows into emission element EL according to gray scale data voltage $V_{DATA}$ in storage capacitor $C_{ST}$. As a result, emission element EL emits light.

As described above, before a gray scale data voltage is carried on a path through driving transistor $M_1$ in a diode-connected state, the gray scale data voltage is carried on a path through transistor $M_2$. An initialization voltage of driving transistor $M_1$ is set based on the gray scale data voltage. Thus, in this embodiment, an initialization voltage may be changed according to a gray scale data voltage $V_{DATA}$ provided to each pixel, and variation in a threshold voltage of the driving transistor $M_1$ of each pixel may be accurately compensated.

By way of summation and review, different compensation techniques have been proposed for suppressing variation in the threshold voltage of a driving transistor. However, as display resolution increases, the time for compensating the threshold voltage is reduced. Also, the degree of accuracy of the compensation changes based on the gray scale data voltage of each pixel.

Figure 9:
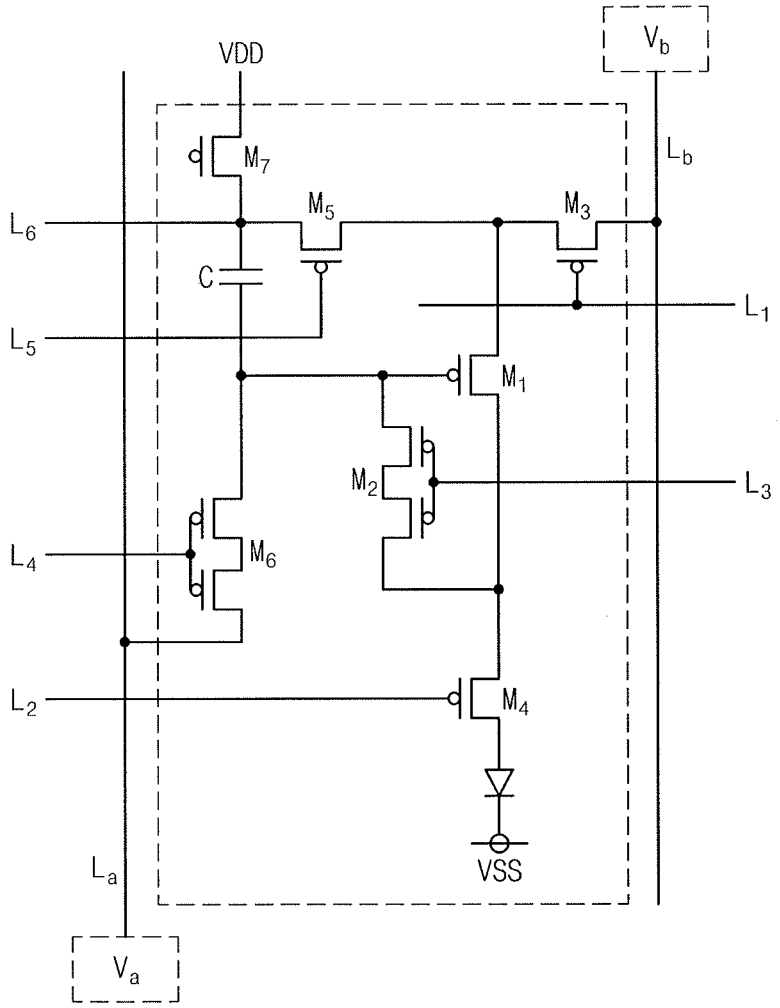
FIG. 9 (RELATED ART)
FIG. 9 illustrates another type of pixel circuit.

In an attempt to address this issue, the pixel circuit illustrated in FIG. 9 has been developed that adjusts an initialization voltage based on the voltage of a source signal line. However, this approach requires the initialization voltage to be prepared for every data line. This increases the complexity of the peripheral circuits of the display, which, in turn, increases manufacturing costs.

Figure 10:
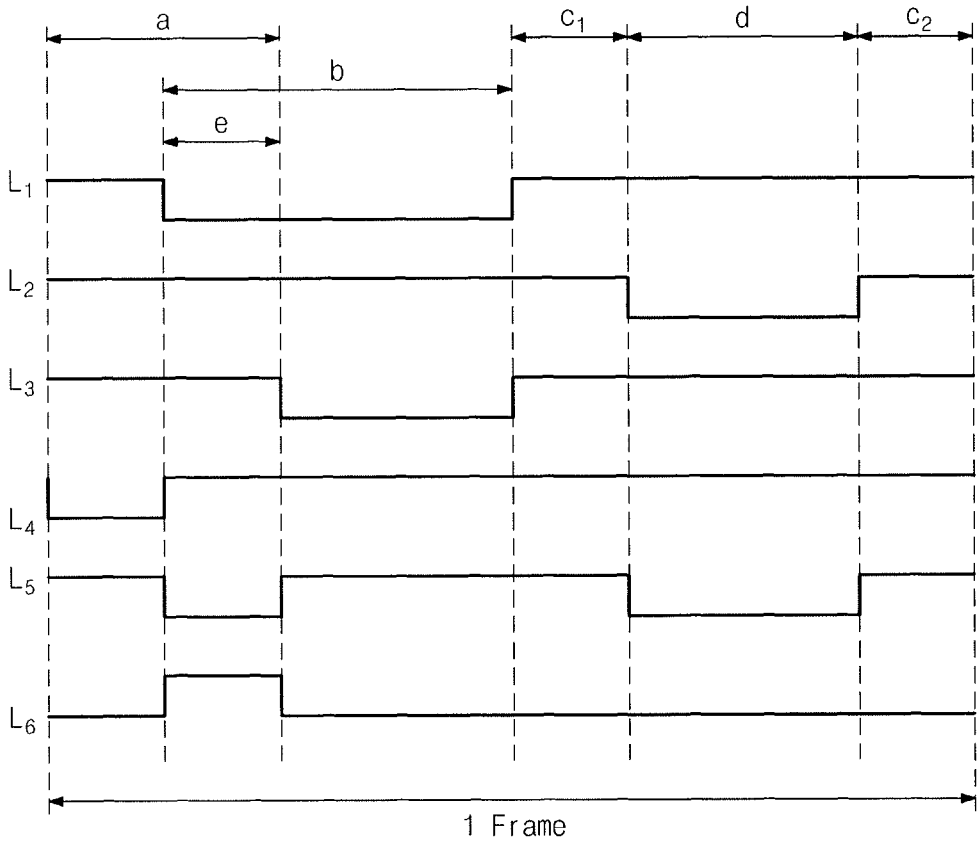
FIG. 10 (RELATED ART)
FIG. 10 illustrates a timing diagram for the pixel circuit of FIG. 9.

A timing diagram for controlling the pixel circuit in FIG. 9 is illustrated in FIG. 10. In FIG. 10, a reset voltage supplied from a reset power Va is written at a gate of driving transistor M1 in reset period (a). Transistors M3 and M5 are turned on during period (e). At this time, because a terminal voltage of one end of capacitor C is changed to a gray scale data voltage supplied to a source signal line from a power supply voltage VDD, a gate voltage of driving transistor $M_1$ may vary according to a voltage variation, and a ratio of capacitance of capacitor C to a stray capacitance of a line electrically connected to the gate electrode of driving transistor $M_1$.

Also, a gray scale data voltage is written during period (b). As a result, transistor $M_5$ is turned off and transistor M7 is turned on, and a gate voltage of driving transistor $M_1$ is returned to the initialization voltage. Thus, it is impossible to change the initialization voltage based on the gray scale data voltage every pixel in this circuit. Also, this pixel circuit increases the number of transistors and control signal lines, thereby making it unsuitable for a high-resolution display device.

In accordance with one or more of the aforementioned embodiments, a pixel circuit includes a driving transistor to provide an emission element with a current corresponding to a gray scale data voltage supplied from a gray scale data signal line DL, a transistor electrically which is connected to a gray scale data signal line and a gate of the driving transistor and which is controlled by a first control signal, a storage capacitor $C_{ST}$ having a first terminal electrically connected to the gate of the driving transistor and a second terminal receiving a second control signal, and a transistor electrically connected to a drain and gate of the driving transistor and controlled by a third control signal. With this configuration, it is possible to change an initialization voltage according to a gray scale data voltage $V_{DATA}$ provided to each pixel, and to accurately compensate for a variation in a threshold voltage of the driving transistor of each pixel.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A method for driving a pixel circuit, the method comprising:

providing an emission element with current corresponding to a gray scale data voltage during a light-emitting period of a horizontal period;

writing the gray scale data voltage to a gate of a driving transistor through a first path during a first period of the horizontal period such that a voltage level of the gate of the driving transistor is same as a voltage level of the gray scale data voltage;

shifting the voltage level of the gray scale data voltage written at the gate of the driving transistor during the first period to set an initialization voltage of the driving transistor during a second period of the horizontal period, the second period being after the first period and before the light-emitting period in the horizontal period;

shifting the gray scale data voltage being shifted during the second period according to a threshold voltage of the driving transistor through a second path including the driving transistor during a third period of the horizontal period, the second path being different from the first path; and changing a voltage level of a second control signal coupled to a terminal of a capacitor electrically connected to a gate of the driving transistor, the voltage level of the second control signal changed between a first operation of writing the gray scale data voltage through the first path and a second operation of writing the gray scale data voltage through the second path, wherein providing the emission element with the current corresponding to the gray scale data voltage is after the second operation, wherein:

the first operation is performed by turning on a first switch and writing the gray scale data voltage to the gate of the driving transistor through the first switch, the first switch electrically connected to a gray scale data signal line providing the gray scale data voltage and the gate of the driving transistor, the first switch controlled by a first control signal, and the second operation is performed by turning on a second switch and writing the gray scale data voltage to the gate of the driving transistor through the second switch and the driving transistor, the second switch electrically connected to a terminal and the gate of the driving transistor, the second switch controlled by a third control signal, and wherein the first operation is performed when the second switch is turned off.

2. A pixel circuit, comprising:

a driving transistor to provide an emission element with current corresponding to a gray scale data voltage during a light-emitting period of a horizontal period;

a first path coupled to a gate of the driving transistor;

a second path passing through a source and a drain of the driving transistor;

a first switch in the first path; and a second switch in the second path, wherein the first switch is controlled by a first signal and the second switch is controlled by a second signal, wherein:

the gray scale data voltage being transferred through the first path is charged to the gate of the driving transistor during a first period of the horizontal period such that a voltage level of the gate of the driving transistor is same as a voltage level of the gray scale data voltage, an initialization voltage of the driving transistor is charged during a second period of the horizontal period by shifting the voltage level of the gray scale data voltage being charged to the gate of the driving transistor during the first period of the horizontal period, the second period being after the first period and before the light-emitting period in the horizontal period, and a voltage is stored in a capacitor coupled to the gate of the driving transistor based on the gray scale data voltage carried along the second path, the voltage stored in the capacitor based on the gray scale data voltage, and wherein:

the first signal has a first value when the second signal has a second value, and the second signal has the first value when the first signal has the second value.

3. The pixel circuit as claimed in claim 2, wherein the first and second signals are scan signals.

4. The pixel circuit as claimed in claim 2, wherein the first and second paths are coupled to a data line.

5. The pixel circuit as claimed in claim 4, wherein at least one of the first path or the second path receives a power voltage from the data line.

* * * * *